US006929590B2

(12) United States Patent
Kobayashi

(10) Patent No.: US 6,929,590 B2
(45) Date of Patent: Aug. 16, 2005

(54) PUNCH PRESS

(75) Inventor: Hiroshi Kobayashi, Kani (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 611 days.

(21) Appl. No.: 09/938,551

(22) Filed: Aug. 27, 2001

(65) Prior Publication Data

US 2002/0033086 A1 Mar. 21, 2002

(30) Foreign Application Priority Data

Sep. 20, 2000 (JP) ..... 2000-284537

(51) Int. Cl.[7] ..... B23Q 3/155
(52) U.S. Cl. ..... 483/29
(58) Field of Search ..... 483/28, 29; 72/446; 83/563

(56) References Cited

U.S. PATENT DOCUMENTS 5,342,276 A * 8/1994 Fujiwara et al. ..... 483/29
5,443,436 A * 8/1995 Kawakami et al. ..... 483/29
6,013,017 A * 1/2000 Aizawa ..... 483/29
6,394,941 B2 * 5/2002 Kawamoto et al. ..... 483/29

FOREIGN PATENT DOCUMENTS

JP 2584278 8/1998
JP 2000-351028 A * 12/2000

* cited by examiner

*Primary Examiner*—Erica Cadugan
(74) *Attorney, Agent, or Firm*—Westerman, Hattori, Daniels & Adrian, LLP

(57) ABSTRACT

A punch press capable of carrying out various processing with few tools, and the exchanging of cartridges efficiently. The punch press includes a punch frame 2 having upper and lower transferring and loading paths 17, 18 wherein upper and lower cartridges 7 loaded with a punch tool and a die tool, respectively, move in or move out freely. A ram 38 drives the punch tool of the upper cartridge 7. The transferring and loading paths 17, 18 are employed wherein the upper and lower cartridges 7 are capable of being stored and discharged to the inside and the outside of the press frame 2 independently. The upper and lower transferring and loading paths 17, 18 are capable of storing at least two cartridges 7 to the front and the back of the moving-in and moving-out direction. The cartridge transferring and loading paths 17, 18 are capable of transferring independently the front and back cartridges 7.

3 Claims, 6 Drawing Sheets

PUNCH PRESS

FIELD OF THE INVENTION

The present invention relates to a cartridge-type punch press adopting the cartridge for the means to support the tool.

BACKGROUND OF THE INVENTION

The cartridge-type punch press freely exchanges the cartridge loaded with tool in the press frame, and by increasing the number of cartridges to be prepared, the number of tools capable of being used increases in a great deal. As a result, various kinds of processing can be carried out.

In the cartridge-type punch press, for the cartridge, there are an upper cartridge loaded with punch tool and a lower cartridge loaded with die tool. These upper and lower cartridges are always made in a pair, and for example, an employment to the working position inside the press frame, or a transfer, a storage into the cartridge magazine can be carried out.

Likewise, since the upper and lower cartridges are always handled in a pair, the punch tool and the die tool to be loaded on these cartridges are required to be employed as a pair in the cartridge. Therefore, even in the case the punch tool and the die tool are capable of being used by being combined to one another, the punch tool and the die tool cannot be combined to the punch tool and the die tool of the cartridge which is not the other half of the pair. As a result, a great number of punch tools and die tools are needed to be prepared, and the equipment expenses are prone to be high.

For example, in the punch processing, the appropriate clearance between the punch tool and the die tool differs according to the sheet thickness or material quality. Therefore, when processing the work sheet of various kinds of sheet thickness or material quality, in the hole processing of the same radius, a pair of the punch tool and the die tool of which the clearance differs a little is prepared, and is used separately according to the object. Such hole processing of the same radius of which the clearance differs, can be carried out by differentiating either one of the punch tool or the die tool, and applying the same tool for the other. However, since the upper and lower cartridges are always handled in a pair, the common use cannot be carried out. Moreover, the same pair of the punch tool and the die tool to be used frequently are prepared in a plurality, and when the life ends, the spare pair is made to be used so that the machine can be kept operating without being stopped, even when the tool reaches the end of the life as a result of abrasion, for example. In this case, even if the difference in the length of the life of the punch tool and the die tool is large, there is a need to prepare a plurality per each pair, and a great number of the tools are needed to be prepared.

Moreover, there is a conventional punch press capable of storing two cartridges in the front and the back of the moving-in and moving-out direction in the press frame to increase the efficiency of the exchanging of the cartridges. The transferring of the cartridges inside the press frame is carried out by connecting two cartridges into a connection body, and transferring the two together.

However, in the transferring of the two cartridges by connecting as described above, the other remaining cartridge cannot be transferred or discharged while the processing is carried out by using one cartridge. Therefore, the storing, the discharging of the cartridges to the press frame, in other words, the exchanging of the cartridges, is inefficient.

It is thus an object of the present invention to provide a punch press capable of carrying out various processing with a small number of punch tools.

It is another object of the present invention to improve the efficiency of the exchanging of the cartridges.

It is a still further object of the present invention to simplify the structure and to reduce the amount of time required to exchange the cartridges.

SUMMARY OF THE INVENTION

The punch press according to the present invention comprises a press frame including an upper transferring and loading path and a lower transferring and loading path wherein a cartridge capable of loading a punch tool, and the cartridge capable of loading a die tool corresponding to the punch tool, can freely move-in or move-out, and a ram for driving the punch tool loaded on the upper cartridge employed in the press frame, and the cartridge transferring and loading means for enabling the storing and discharging of the upper and lower cartridges independently to the inside of the press frame and the outside of the press frame.

According to this construction, the punch processing is carried out by driving the punch tool of the upper cartridge by the ram, by using the upper cartridge and the lower cartridge located at the working position inside the press frame. The upper and lower cartridges inside the press frame are capable of being stored and discharged to the inside and outside of the press frame independently, by the cartridge transferring and loading means. Therefore, for example, only the lower cartridge can be exchanged with the one located outside the machine, while leaving the upper cartridge in the press frame. As a result, for example, by exchanging with the lower cartridge with die tool of differing clearance loaded, the combination of the punch tool and the die tool can be changed to the one having different clearance and the punch processing can be carried out. As a result, the processing of many kinds of clearance can be carried out by one kind of punch tool and the number of the punch tools to be prepared can be made small. Moreover, for example, when the punch tool of the upper cartridge abrades or is damaged, by preparing separately the cartridge loaded with a spare punch tool having interchangeability, only the upper cartridge can be exchanged and the die tool can be kept using. Thus, in the case the punch tool is prone to be easily damaged or the life is short, comparing to the die tool, by preparing a plurality of the punch tools only, the damage or the life can be dealt rapidly with a small number of tools.

In the present invention, the upper and lower transferring and loading paths can be made capable of storing at least two cartridges in the front and back of the moving-in and moving-out direction, and the cartridge transferring and loading means can be made capable of transferring the front cartridge and the back cartridge independently.

Likewise, when enabling the storing of a plurality of cartridges in the press frame, comparing to the case in which exchanging with the cartridge placed outside of the machine, the exchanging of the cartridges to be used can be carried out rapidly between a plurality of cartridges inside the machine. Moreover, the cartridge transferring and loading means is capable of transferring the front cartridge and the back cartridge independently. Therefore, the other cartridge inside the press frame can be exchanged with the cartridge placed outside of the machine while the punch processing is carried out by using the cartridge located at the working position. As a result, the exchanging of the cartridges can also be carried out rapidly with the cartridge located in the outside of the machine. Moreover, the cartridge transferring and loading means is made capable of carrying out automatic operation of various kinds of cartridge exchanging forms, as a result of enabling the independent transferring of a plurality of cartridges of more than a total of four units which are employed to the upper and lower sides respectively.

In the present invention, the cartridge transferring and loading means can be made to transfer the cartridges by transferring an engaging member engaged freely engaging and disengaging to the cartridge, along the transferring and loading path. The transferring and loading path, and the transferring path of the engaging and disengaging member can be made into a straight lined path.

Likewise, by making the cartridge engaging member transferring along the transferring and loading path of the cartridge, to transfer the cartridges, the structure of the cartridge transferring and loading means can be simplified. Moreover, when making the transferring and loading path of the cartridge, and the transferring path of the engaging member, into a straight lined path, the structure can be even more simplified, and the amount of time required to exchange the cartridges can be reduced.

DETAILED DESCRIPTION OF PREFERRED EMBODIMENTS

Figure 1:
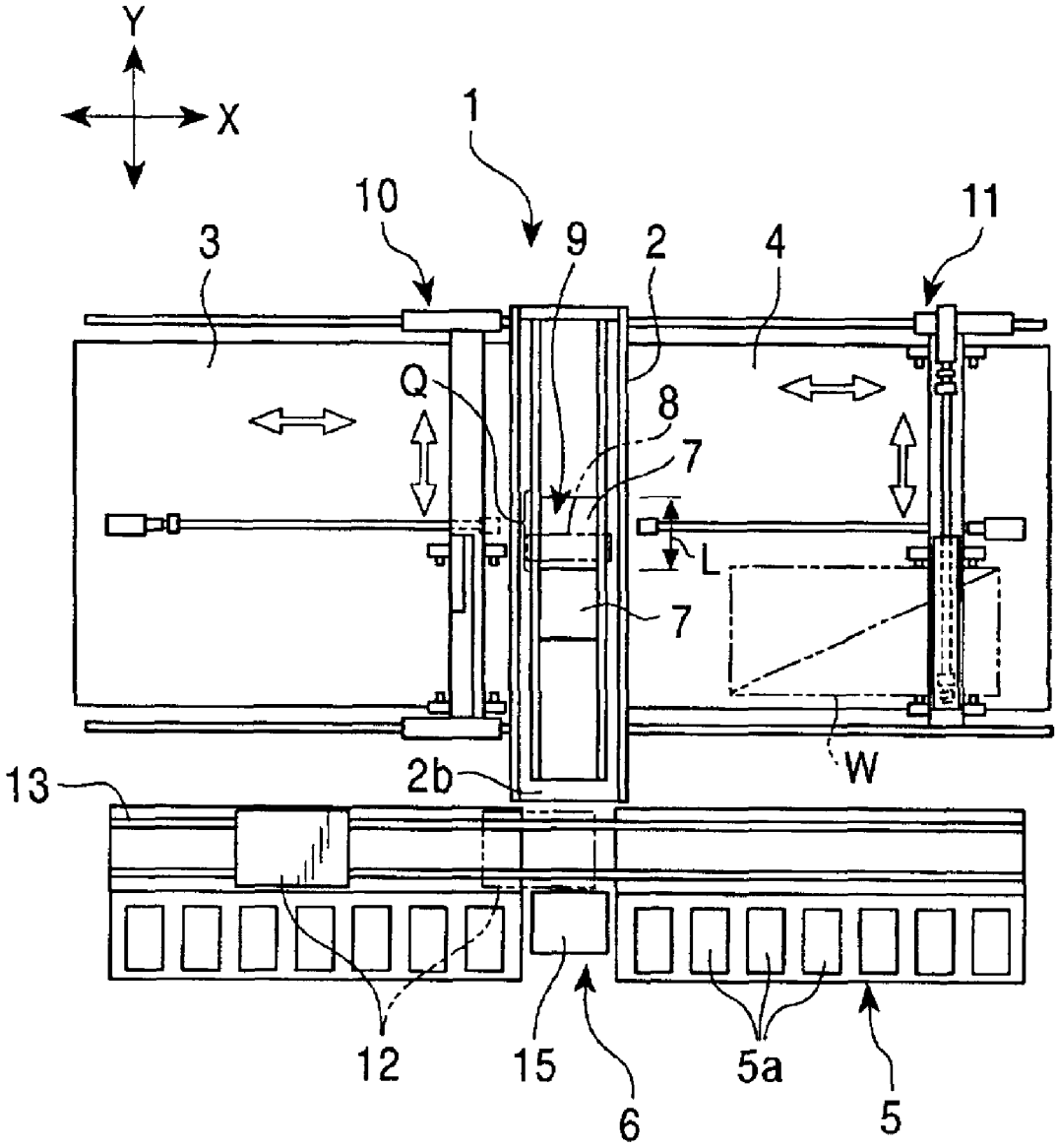
FIG. 1 is a top view of the punch press according to an embodiment of the present invention.

An embodiment of the present invention will be described in reference to FIG. 1 through FIG. 6. A punch press 1 is a cartridge-typed, and tables 3, 4 are employed to both sides of a press frame 2, and a tool magazine 5 and a cartridge exchanging device 6 are employed in parallel to the press frame 2 and the arrangement of the tables 3, 4. The press frame 2 employs a cartridge 7 loaded with a plurality of tools in the longitudinal direction (Y direction) of the press frame 2, freely inserting and exerting, and a press head 8 for driving a punch tool of the cartridge 7. The cartridge 7 is employed with the punch tool loaded cartridge 7 and the die tool loaded cartridge 7 placed opposing to each other vertically, and is used by being fixed to the press frame 2 at a working position Q. The plane figure of the cartridge 7 is formed in the rectangular shape. The press head 8 is capable of transferring within the prescribed area L in the same direction (Y direction) as to the transferring direction of the cartridge 7 within the press frame 2, for selecting the random tool loaded on the cartridge 7.

A work sheet feeding means 10, 11 for transferring a work sheet W on the surfaces of the tables 3, 4 are employed on the tables 3, 4. The work sheet feeding means 10, 11 are employed to each work tables 3, 4. These work sheet feeding means 10, 11 enable the feeding of the work sheet W in the direction in which the two axes (X axis, Y axis) come in at right angles.

The tool magazine 5 stores the cartridge 7 employed inside the press frame 2 capable of being exchanged, and a plurality of storing units 5*a* are arranged in a straight line, to store a pair of the upper and lower cartridges 7.

The cartridge exchanging device 6 employs a cartridge exchanging mechanism 15 for carrying out the transferring and loading of the cartridge 7 between a cart 12 and the press frame 2 wherein the cart 12 is employed capable of running on rails 13, along the line of storing units 5*a* of the tool magazine 5. The cartridge exchanging mechanism 15 can be loaded on the cart 12. The cart 12 is capable of carrying a plural number of pairs by arranging in the cart running direction, the cartridge 7 of which has become a pair of the upper and lower side or one of the pair.

Figure 2:
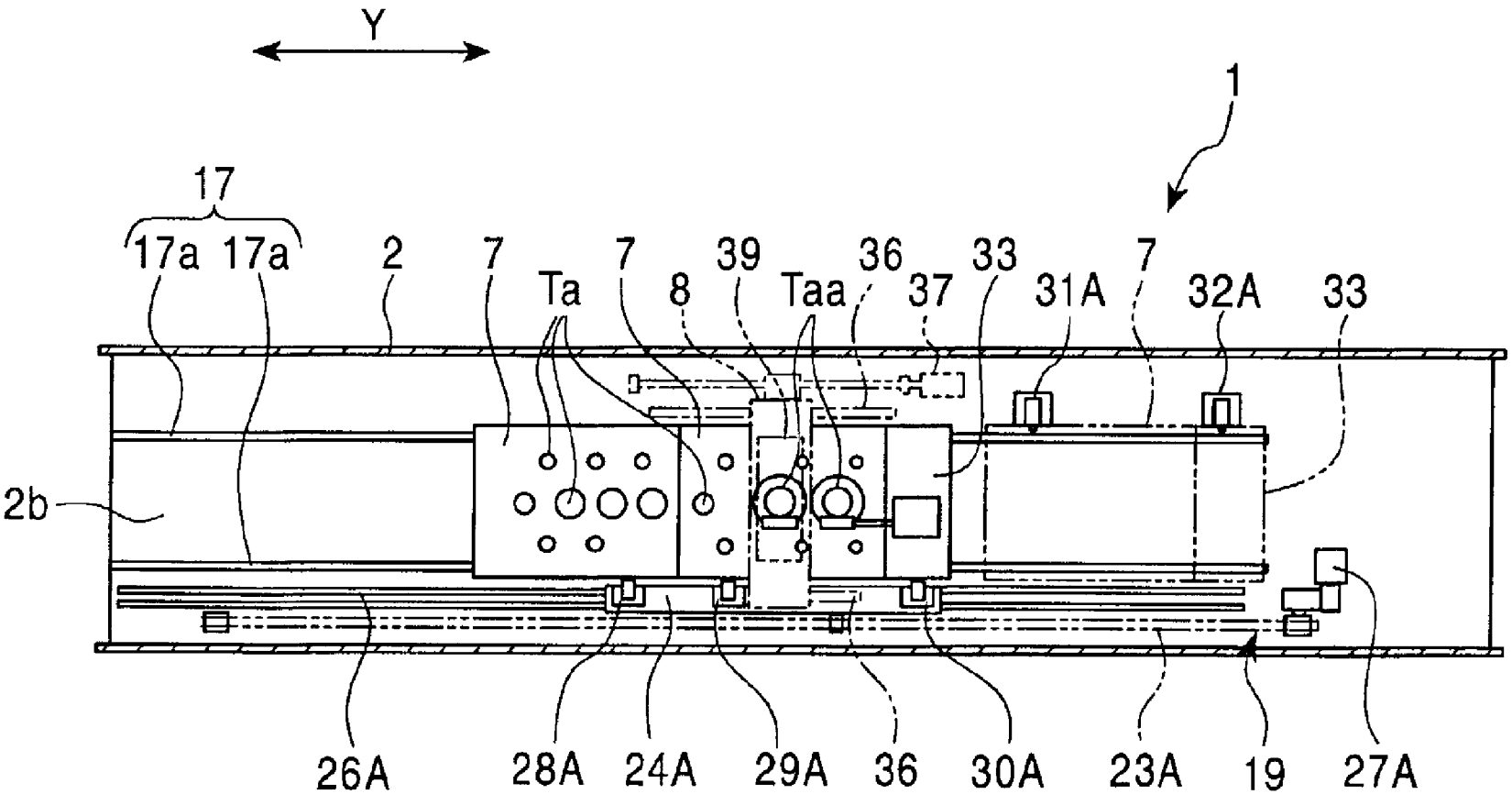
FIG. 2 is an enlarged exploded side view showing the press frame section of the punch press.

As shown in FIG. 2, a plurality of punch tools Ta are employed in the upper cartridge 7, and arranged in plural lines along the advancing and receding direction (Y direction) of the cartridge 7. These punch tools Ta are supported by the cartridge 7 freely elevating and descending. Some punch tools Taa of some cartridges 7 are made to be the rotation indexing tools capable of changing the rotating angle. The die tool (not shown in the drawing) is employed in the lower cartridge 7 (FIG. 3), corresponding to each punch tool Ta of the upper cartridge 7.

Figure 3:
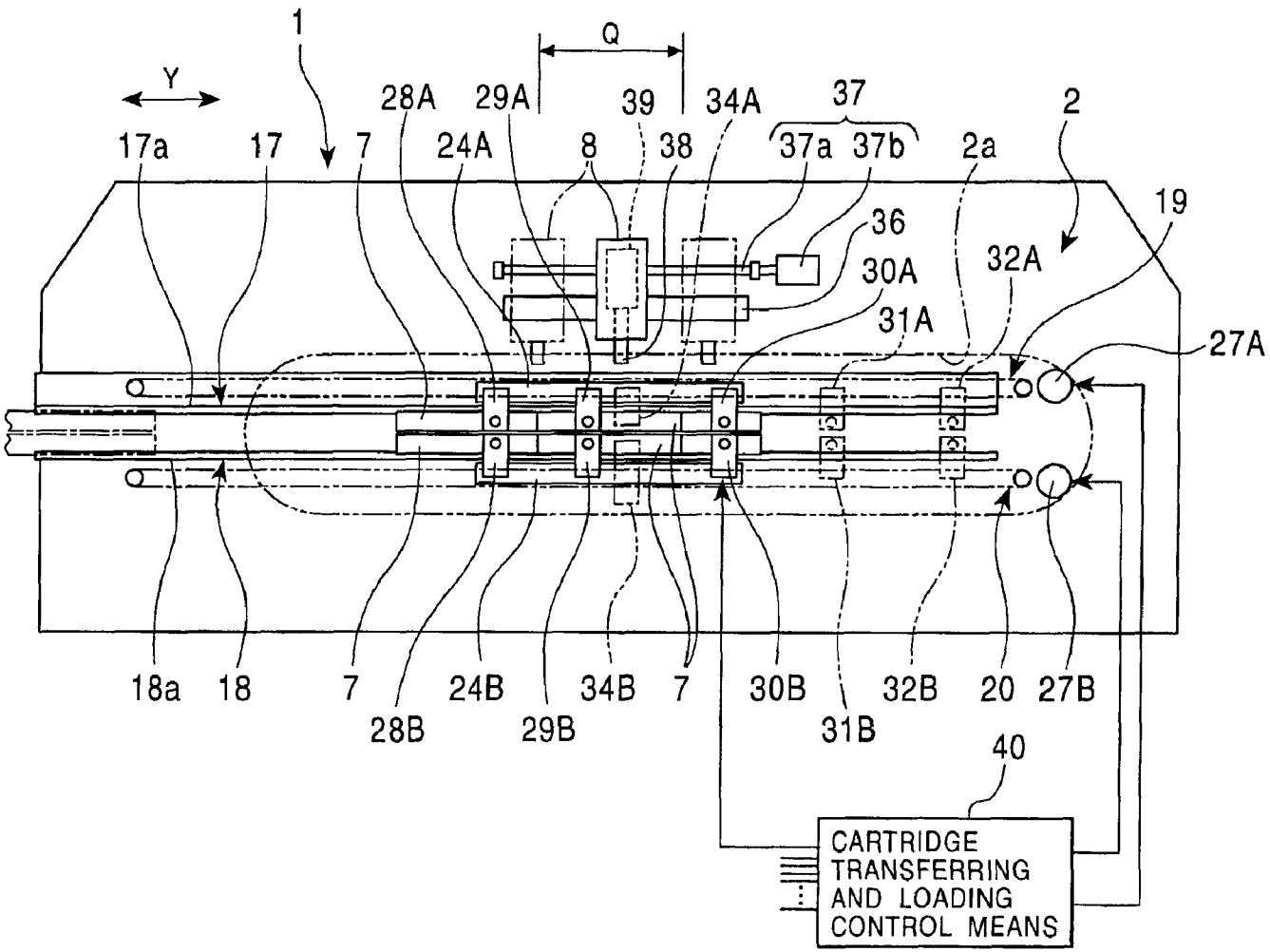
FIG. 3 is an enlarged sectional view of the same.
Figure 4:
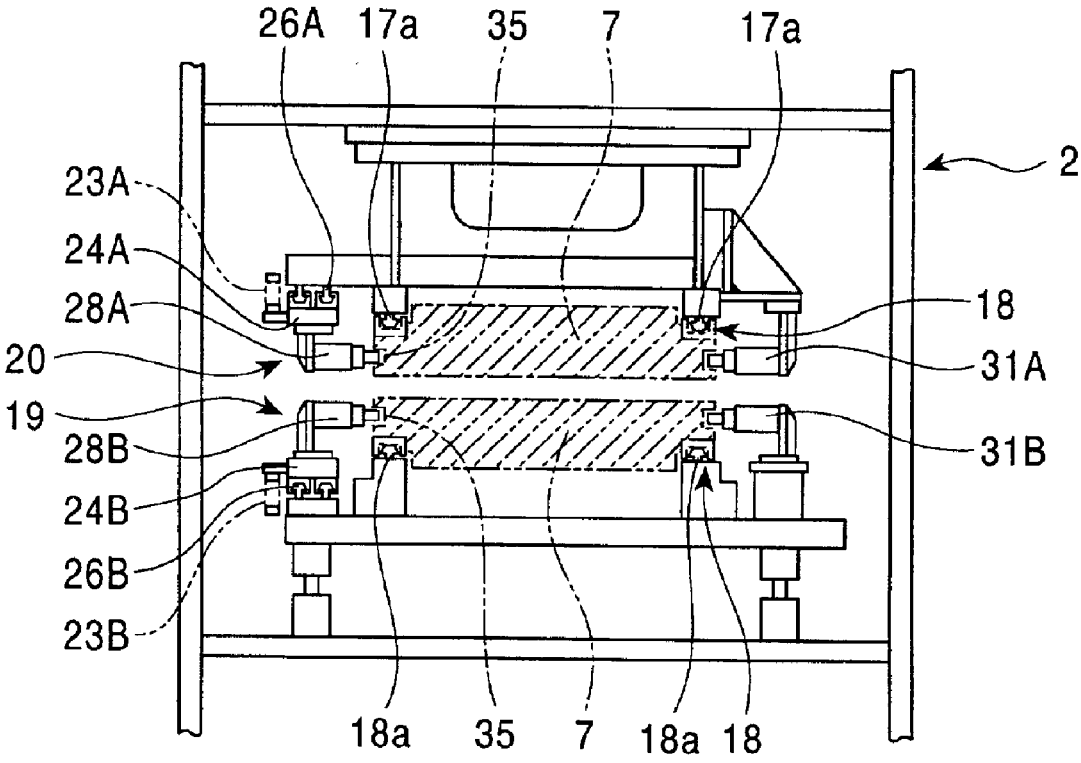
FIG. 4 is an enlarged exploded front view of the same.

As shown in FIG. 3, the sectional shape of the press frame 2 is formed in the shape of a square by the formation of a side opening 2*a*, and the work sheet W on the tables 3, 4 (FIG. 1) in the side opening 2*a* is capable of passing through the press frame 2.

The press head 8 is loaded with a punch driving mechanism 39 for elevating and descending a ram 38 for driving the punch tool of the cartridge 7. The punch driving mechanism 39 is preferable to be light weighted, and for example, a mechanism for changing the rotation of the servo motor into the straight line reciprocating movement of the crank mechanism or the like, or a hydraulic typed mechanism are to be used. The press head 8 is employed in the longitudinal direction (Y direction) of the press frame 2 capable of advancing and receding, along a guide 36 employed in the press frame 2, and is driven advancing and receding by a press head advancing and receding device 37. The press head advancing and receding device 37 is comprised of a feeding screw 37*a* of a ball screw or the like, and a servo motor 37*b*.

The press frame 2 comprises transferring and loading paths 17, 18 formed in a straight line for guiding the upper and lower cartridges 7, 7 by freely transferring in the longitudinal direction of the press frame 2, and cartridge transferring and loading means 19, 20 for advancing and receding the cartridges 7, 7 along the transferring and loading paths 17, 18. The transferring and loading paths 17, 18 are formed by employing a pair of guides 17*a*, 18*a* respectively in parallel. Both guides 17*a*, 18*a* are employed in parallel at the same level so that the guiding of the both sides of the cartridge 7 can be carried out. The direct driven axis or the like are adopted for the guides 17*a*, 18*a*. At one edge of the transferring and loading paths 17, 18, the moving-in and moving-out of the cartridge 7 is made free, and forms an entry 2*b* of the cartridge 7 into the press frame 2.

In the upper and lower transferring and loading paths 17, 18, a tool rotating means pallet 33 is employed in the front side (the opposite side to an entry 2*b*) of the arrangement of the cartridges 7, freely advancing and receding in the same manner as the cartridge 7, and is made capable of transferring by the cartridge transferring and loading means 19, 20. The tool rotating means pallet 33 is loaded with the tool rotating means for rotating the indexing tool, out of the punch tools Ta and the die tools which are loaded on the cartridge 7.

The upper and lower cartridge transferring and loading means 19, 20 transfer the cartridge 7 by engaging members 28A, 28B, 29A, 29B engaged to the front and back cartridges 7 freely engaging and disengaging, being transferred along the transferring and loading paths 17, 18. Each engaging member 28A, 28B, 29A, 29B engage freely engaging and disengaging, the position locating parts such as a pin, by the engaging and disengaging driving means of the cylinder device or the like, to a designated engaged portion 35 (FIG. 4) of the cartridge 7. The engaged portion 35 is comprised of holes employed on the side of the cartridge 7. The upper and lower cartridge transferring and loading means 19, 20 further comprise engaging members 30A, 30B for engaging to the rotating tool pallet 33. These engaging members 30A, 30B have the same structure as each engaging members 28A, 28B.

Each engaging members 28A, 29A, 30A of the upper side are employed in a common running body 24A. The running body 24A is employed freely running in a transferring path 26A employed along the transferring and loading path 17 of the cartridge 7. Each engaging members 28B, 29B, 30B of the lower side are employed in a common running body 24B, in the same manner as in the upper side.

The running body 24B is employed freely running on the transferring path 26B employed along the transferring and loading path 18 of the cartridge 7.

The upper and lower transferring paths 26A, 26B are comprised of a straight line formed guide respectively, and the running bodies 24A, 24B are employed in the transferring paths 26A, 26B via the direct driven axis or the like. These running bodies 24A, 24B are connected to conveying systems 23A, 23B which have no edges such as a belt, or a chain, and are advanced and receded by the swing driving of the conveying systems 23A, 23B by driving sources 27A, 27B of the motors or the like.

The upper and lower cartridges 7 inside the press frame 2 are made capable of being fixed by each cartridge fixing means 34A, 34B respectively at the designated position where the punch processing is to be carried out. These cartridge fixing means 34A, 34B restrict the advancing and receding of the cartridge 7 employed freely advancing and receding in the transferring and loading paths 17, 18. The cartridge fixing means 34A, 34B can be comprised of the position locating parts such as a cylinder device and a pin, or a means for fixing the cartridge 7 by friction, contacting etc. in the same manner as the engaging members 28A through 30B. For example, when engaging the engaging members 28A through 30B to one of the sides of the cartridge 7, the cartridge fixing means 34A, 34B are engaged to the side opposite to aforementioned side of the cartridge 7.

In the inner part of the transferring and loading paths 17, 18, receding section fixing means 31A, 31B, 32A, 32B for fixing at a prescribed position, the cartridge 7 and the tool rotating means pallet 33 receded to the inner part of the working position Q, are employed. These receding section fixing means 31A, 31B, 32A, 32B can be made in the same structure as the engaging members 28A, 28B, or can be of a different structure. Moreover, the receding section fixing means 31A, 31B, 32A, 32B are engaged to the side opposite to the engaging side by the engaging members 28A through 30B of the cartridge 7.

The driving sources 27A, 27B and each engaging members 28A through 30B for the vertical advancing and receding of the cartridge transferring and loading means 19, 20 are capable of moving independently. The cartridge transferring and loading means 19, 20 are capable of transferring selectively the cartridges 7 of any position independently. A cartridge transferring and loading control means 40 controls these driving sources 27A, 27B and each engaging members 28A through 30B. The cartridge transferring and loading control means 40 composes a part of the computer-type control device for controlling the entire punch press.

Figure 5A:
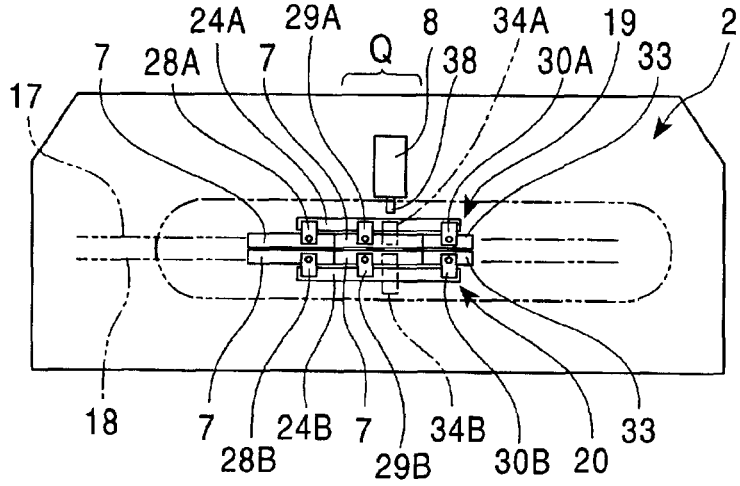
FIG. 5 is a view useful for explaining the operational condition of the punch press.

The operation of aforementioned structure will now be described. As shown in FIG. 5A, the punch press transfers the upper and lower cartridges 7 to the working position Q at the transferring and loading paths 17, 18, and is fixed at the cartridge fixing means 34A, 34B. The ram 38 drives any punch tool Ta (FIG. 2) of the fixed cartridge 7, and the punch processing such as a hole opening process to the work sheet W is carried out by the punch tool Ta and the corresponding die tool.

Normally, two cartridges 7 are stored to each of the transferring and loading paths 17, 18 of the press frame 2, and the punch processing is carried out by freely exchanging and transferring to the working position Q, two cartridges 7 of the front and the back. Therefore, comparing to the case in which exchanging the cartridges 7 between the outside of the machine, the exchanging of the cartridges 7 can be carried out speedily and many punch tools, die tools can be used.

Figure 5B:
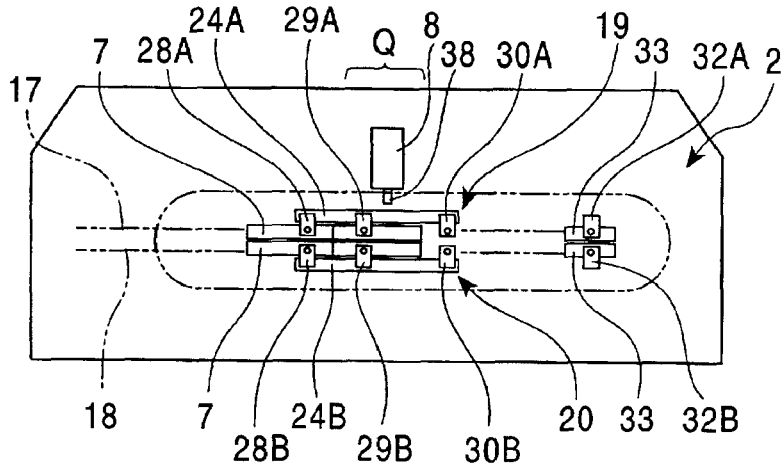

The tool rotating means pallet 33 is applied only in the case the cartridge 7 at the working position Q is loaded with the rotation indexing tool Taa (FIG. 2), and as shown in FIG. 5B, normally, is receded to the front side of the transferring and loading paths 17, 18, and is stopped at the receding section fixing means 32A, 32B.

Figure 5C:
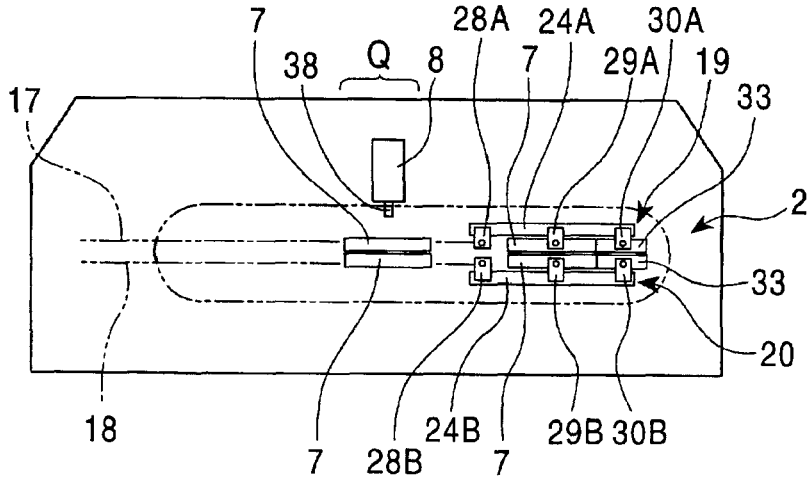

Moreover, in the case of using the cartridge 7 of the back side of the transferring and loading paths 17, 18, as shown in FIG. 5C, the cartridge 7 of the front side recedes to at least the front of the working position Q by the cartridge transferring and loading means 19, 20, and is stopped at the receding section fixing means 31A, 31B (FIG. 3).

Figure 6A:
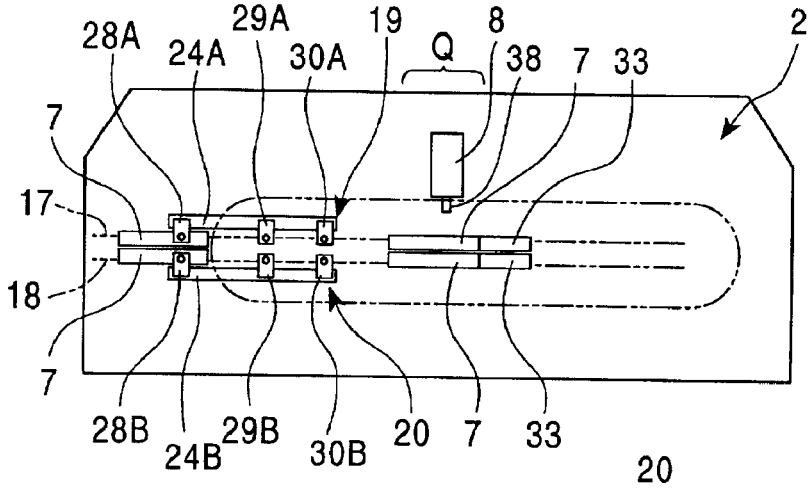
FIG. 6 is a view useful for explaining the other operational condition of the punch press.

Each engaging members 28A through 30B are capable of driven by engaging and disengaging independently, and the cartridge transferring and loading means 19, 20 are capable of freely transferring while the punch processing is carried out. As a result, as shown in FIG. 6A, the other cartridge 7 can be stored and discharged to the inside and outside of the press frame 2 while the punch processing is carried out by adopting either cartridge 7 placed in the front or the back sides. Likewise, since the cartridge 7 can be exchanged between the outside of the machine while the processing is being carried out, the exchanging of the cartridges 7 can be carried out efficiently.

Figure 6B:
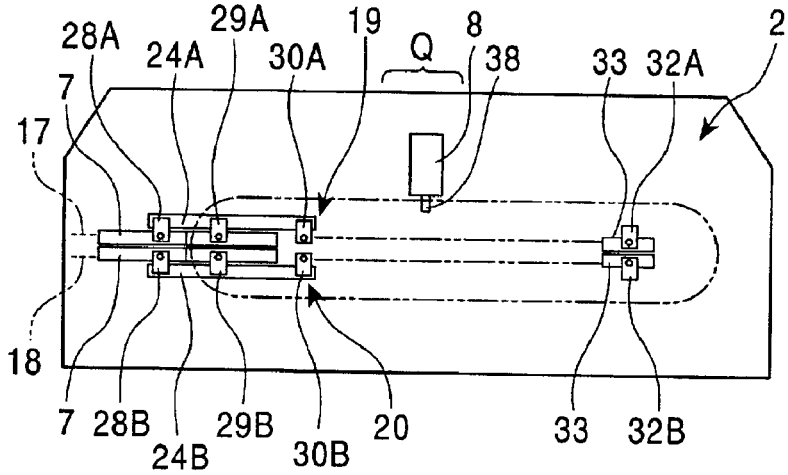

Moreover, as shown in FIG. 6B, the cartridge transferring and loading means 19, 20 are capable of transferring a plurality of cartridges 7 arranged in the front and the back at the same time, wherein the running bodies 24A, 24B are capable of running with each engaging members 28A through 30B engaged at the same time. As a result, when exchanging a plurality of cartridges 7 at the same time, the exchanging work can be carried out efficiently. In the embodiment, the cartridge transferring and loading means 19, 20 are capable of transferring the tool rotating means pallet 33 at the same time along with a plurality of cartridges 7.

Figure 6C:
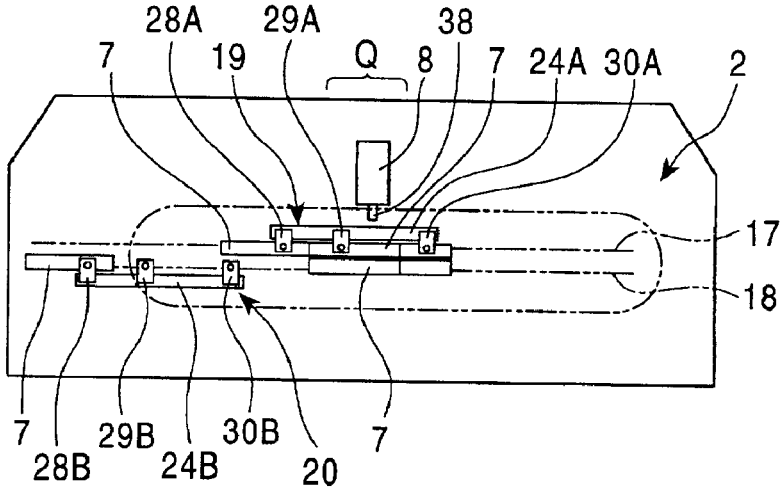

As shown in FIG. 6C, the upper and lower cartridge transferring and loading means 19, 20 are capable of transferring independently of one another and only the lower cartridge 7 can be transferred. In addition, only the upper cartridge 7 can be transferred. The independent transferring of such upper and lower cartridge transferring and loading means 19, 20 can also be carried out in the midst of the punch processing.

Likewise, since the upper and lower cartridge transferring and loading means 19, 20 can be driven independently, for example, the punch processing can be carried out by leaving the upper cartridge 7 as it is, exchanging the lower cartridge 7 loaded with die tool of differing clearance, and changing the combination of the punch tool and the die tool into the one having differing clearance. Therefore, the processing of various kinds of clearance can be carried out by one kind of punch tool, and the number of tools to be prepared can be small. Moreover, for example, when the punch tool of the upper cartridge 7 abrades or is damaged, by preparing separately the cartridge 7 loaded with a spare punch tool having interchangeability, only the upper cartridge 7 can be exchanged and the die tool can be kept used. Therefore, in the case the punch tool is prone to be damaged or the length of the life is short, compared to the die tool, by preparing a plurality of the punch tools only, the damage or the life can be handled rapidly with a small number of tools.

The punch press according to the present invention comprises a press frame including the upper and lower transferring and loading paths wherein a cartridge capable of loading the punch tool, and the cartridge capable of loading the die tool corresponding to the punch tool, can freely move-in or move-out, and a ram for driving the punch tool loaded on the upper cartridge employed in the punch frame, and a cartridge transferring and loading means for enabling the storing and the discharging of the upper and lower cartridges independently to the inside and the outside of the press frame. As a result, various processing can be carried out by a small number of tools.

In the case the upper and lower transferring and loading paths are capable of storing at least two cartridges in the front and the back of the moving-in and moving-out direction, and the cartridge transferring and loading means is capable of transferring the front and back cartridges independently of one another, the efficiency of the exchanging of the cartridges can be improved.

In the case the cartridge transferring and loading means transfers the cartridge by the transferring of the engaging member, engaging to the cartridge, freely engaging and disengaging, along the transferring and loading path, and the transferring and loading path, and the transferring path of the engaging and disengaging member are straight lined paths, the structure can be simplified and the time required for the exchanging of the cartridges can be reduced.

The above described and illustrated punch press disclosed in Japanese Patent Application No. 2000-284537 filed with the Japanease Patent Office on Sep. 20, 2000 and the subject application claims the priority of the above Japanese Patent Application, the entire disclosure of which is incorporated herein by reference.

What is claimed is:

1. A punch press comprising:

a press frame including an upper transferring and loading path and a lower transferring and loading path, wherein an upper cartridge capable of loading a punch tool and a lower cartridge capable of loading a die tool corresponding to the punch tool are freely movable in and out of the press frame via the upper and lower transferring and loading paths;

a ram for driving the punch tool loaded on the upper cartridge employed in the press frame; and a cartridge transferring and loading means comprising an upper cartridge transferring and loading means and a lower cartridge transferring and loading means for transferring the upper and lower cartridges independently of each other along the upper transferring and loading path and the lower transferring and loading path, respectively, to a punch processing position, at which position punching occurs.

2. The punch press according to claim 1, wherein said upper and lower transferring and loading paths respectively store at least two cartridges at different positions in a longitudinal direction of the press frame, and the cartridge transferring and loading means transfers the at least two cartridges independently of each other.

3. The punch press according to claim 1 or claim 2, further comprising:

an engaging and disengaging member freely engageable and disengageable to a cartridge along the transferring and loading path, wherein the cartridge transferring and loading means transfers the cartridge by transferring of the engaging member along the transferring and loading path when the engaging member is engaged to the cartridge, and the transferring and loading path and a transferring path of the engaging and disengaging member are a straight lined path.

* * * * *